United States Patent [19]

Fabre

[11] Patent Number: 5,050,645

[45] Date of Patent: Sep. 24, 1991

[54] MOBILE WEFT CLAMPS FOR A SHUTTLE BOX LOOM

[76] Inventor: Aimé Fabre, La Pomatitèore, Brangues 38510, France

[21] Appl. No.: 482,766

[22] Filed: Feb. 21, 1990

[30] Foreign Application Priority Data

Feb. 28, 1989 [FR] France ..... 89 02870

[51] Int. Cl.[5] ..... D03D 45/50

[52] U.S. Cl. ..... 139/170.3; 139/194; 139/430

[58] Field of Search ..... 139/257, 258, 194, 170.3, 139/184, 430, 171, 436, 54, 256 R

[56] References Cited

U.S. PATENT DOCUMENTS

| | | | |
|---|---|---|---|
| 3,452,784 | 7/1969 | Sides | 139/256 R |
| 3,507,307 | 4/1970 | Picanol | 139/170.3 |
| 3,613,741 | 10/1971 | Ravella | 139/430 |
| 3,720,237 | 3/1973 | Keldany | 139/170.3 |
| 3,788,362 | 1/1974 | Blakely | 139/256 R |
| 4,338,971 | 7/1982 | Lucian et al. | 139/194 |

FOREIGN PATENT DOCUMENTS

| | | | |
|---|---|---|---|
| 0279320 | 8/1988 | European Pat. Off. | 139/430 |

*Primary Examiner*—Andrew M. Falik
*Attorney, Agent, or Firm*—Dowell & Dowell

[57] ABSTRACT

Movable clamps are provided on each side of a weaving loom between the selvedge of the fabric being made and the adjacent shuttle box with the number of clamps equal to the number of shuttles and with the clamps, which are offset in a vertical plane, being controlled so that the yarn carried by each shuttle is seized as a shuttle leaves the warp yarn in order to maintain the yarn under tension and thus avoid any risk of yarn entanglement.

10 Claims, 8 Drawing Sheets

MOBILE WEFT CLAMPS FOR A SHUTTLE BOX LOOM

BACKGROUND OF THE INVENTION

1. Field of the Invention

The present invention relates to weaving looms employing one or more shuttles and more particularly to machines of great width of the type used for making tubular fabrics intended for the paper-making industry.

2. Description of the Related Art

In weaving machines of this type, the use of conventional shuttles provided with cops is known to be detrimental to the regularity of the tension of the picks. Moreover, as the width of the fabric to be made is often considerably less than the width of the loom, the lengths of the weft yarns extending laterally between each of the selvedges of the fabric being made and the corresponding shuttle box, tend to become entangled, causing serious weaving defects or untimely of the machinery.

It is a principal object of the present invention to overcome these drawbacks, by employing two selector devices disposed on the loom in front of the batten and adapted to grip and maintain, under tension, each of the weft yarns leaving the shed, prior to the tightening of each pick.

SUMMARY OF THE INVENTION

Each device according to the invention comprises a number of clamps equal to that of the shuttles of the loom. Each of the clamps is carried by an extendable member which is controlled so as to take either a position of extension for which the clamp, abutting against a bearing surface provided on the batten, is adapted to grip the weft yarn under tension, or a retracted position for which the same clamp is on standby outside the reciprocating movement of the batten, or a mean position for which the clamp lies at a short distance from the batten to allow release of the weft yarn when the shuttle penetrates into the shed again. The extendable clamp-holder members are disposed at different levels corresponding to those of each shuttle box and are controlled in height so that the clamp of one cooperates at the opportune moment with the bearing surface of the batten.

It will be readily appreciated that the maintenance of the weft yarns under tension when they emerge from the shed, combined with the variation in inclination of the clamps in the vertical direction, opposes any risk of the weft yarns becoming entangled.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
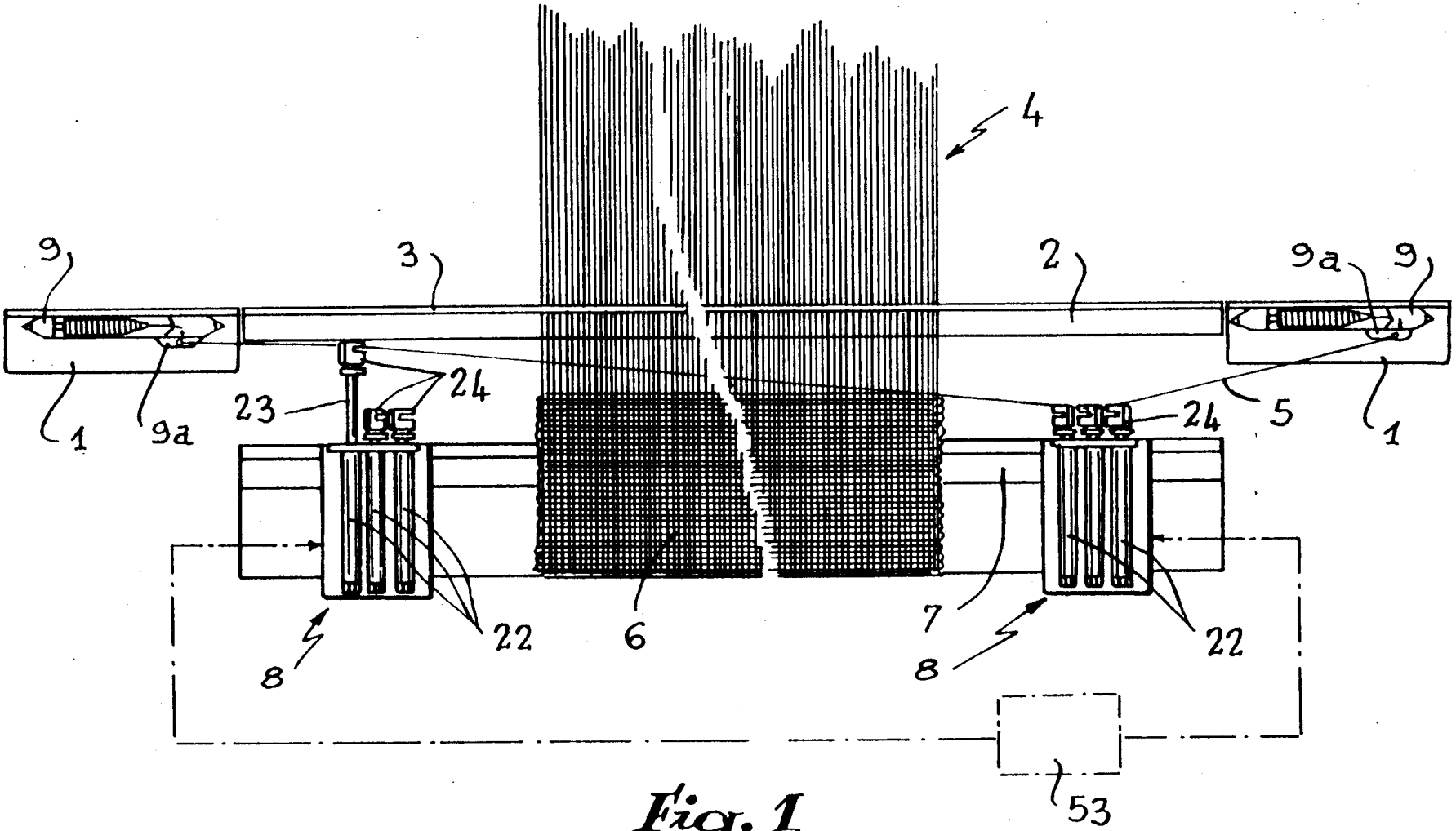
FIG. 1 is a plan view schematically showing the assembly of the two selector devices according to the invention on the front part of a weaving loom.

Referring now to the drawings, in the following description, it has been assumed that the invention is carried out in the case of a weaving loom equipped with two shuttle boxes 1 provided on either side of the conventional batten 2 to which is imparted a transverse reciprocating displacement following the laying of each pick. Each shuttle box 1 comprises three superposed stages for receiving three shuttles and is vertically movable so that each stage is capable of coming, at the opportune moment, into place at the level of the corresponding end of the batten 2, which carries the reed 3. Reference 4 designates all the warp yarns prior to the laying of the weft yarns 5, the fabric 6 obtained being wound on a conventional beam disposed below the rods 7 forming supports for the temples (not shown) which maintain the fabric 6 full-width.

According to the invention, there are fixed to the rails 7 two devices 8 intended to maintain under tension the weft yarns 5 immediately after they have been laid by one of the three shuttles 9 of the loom. Each device 8 lies substantially half-way between the selvedge of the fabric 6 and the adjacent shuttle box 1. These two devices 8 are symmetrically identical to each other, and the explanations given for one of them (the left-hand one in the present case) will consequently be valid for the other.

Figure 2:
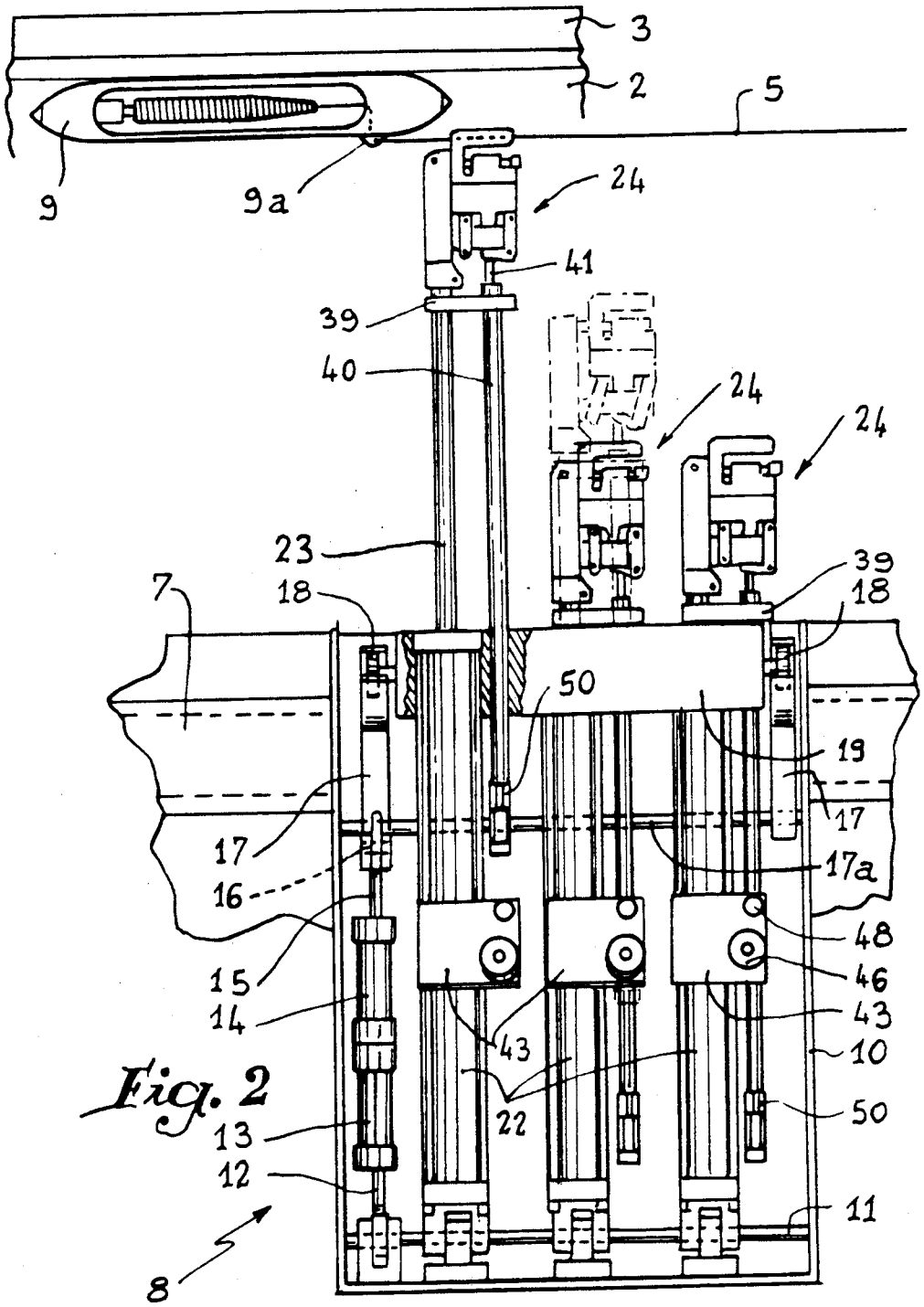
FIG. 2 is a plan view on a larger scale illustrating the arrangement of one of the two devices (the left-hand one in FIG. 1).
Figure 3:
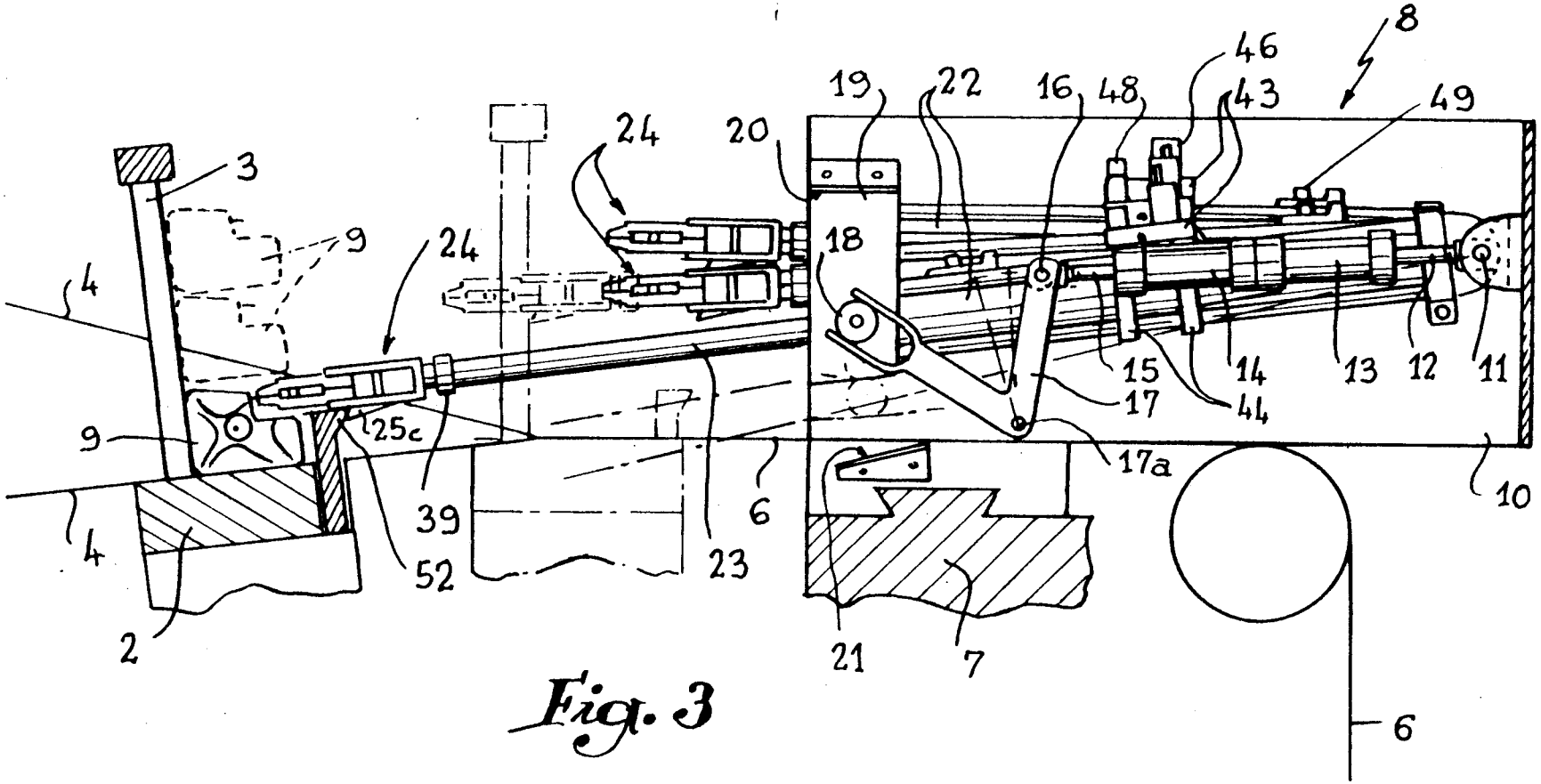
FIG. 3 is a transverse section through the loom, representing the selector device of FIG. 2 in longitudinal section.

As shown in FIG. 2, each device 8 comprises a casing 10 of rectangular section. Near the wall of this casing 10 which is oriented parallel to the batten 2 and opposite thereto is provided a pin 11 on which is articulated the extendable rod 12 of a pneumatic jack whose cylinder 13 is secured with the cylinder 14 of a second pneumatic jack. The extendable rod 15 of the second jack carries at its end a transverse pin 16 on the ends of which are articulated two bent levers 17. As shown in FIG. 3, each bent lever 17 pivots freely at 17*a* on the corresponding wall of the casing 10, while its free end is sectioned as a fork to embrace a roller 18. The pin which supports each roller 18 is fixed laterally against a crosspiece 19 which is free to move vertically in that part of the casing 10 which opens in the direction of the batten 2.

The two pneumatic jacks 12–13 and 14–15 are capable of being controlled in succession to displace the crosspiece 19 vertically and give it either a raised position for which it bears against an upper stop 20 fixed against the casing 10, or a lowered position for which it bears against a lower stop 21 of the casing, or a mean position provided half-way between the two extreme positions indicated above.

The crosspiece 19 forms a common support for the end of cylinder 22 of three pneumatic jacks oriented parallel to one another, but disposed on the crosspiece 19 at three different heights, so as to form a sort of fan in a vertical plane. The opposite end of each cylinder 22 is freely articulated on the pin 11 carried by the casing 10, while the extendable member or rod 23 of each jack extends in the direction of the batten 2 to form a support for a clamp 24.

Figure 4:
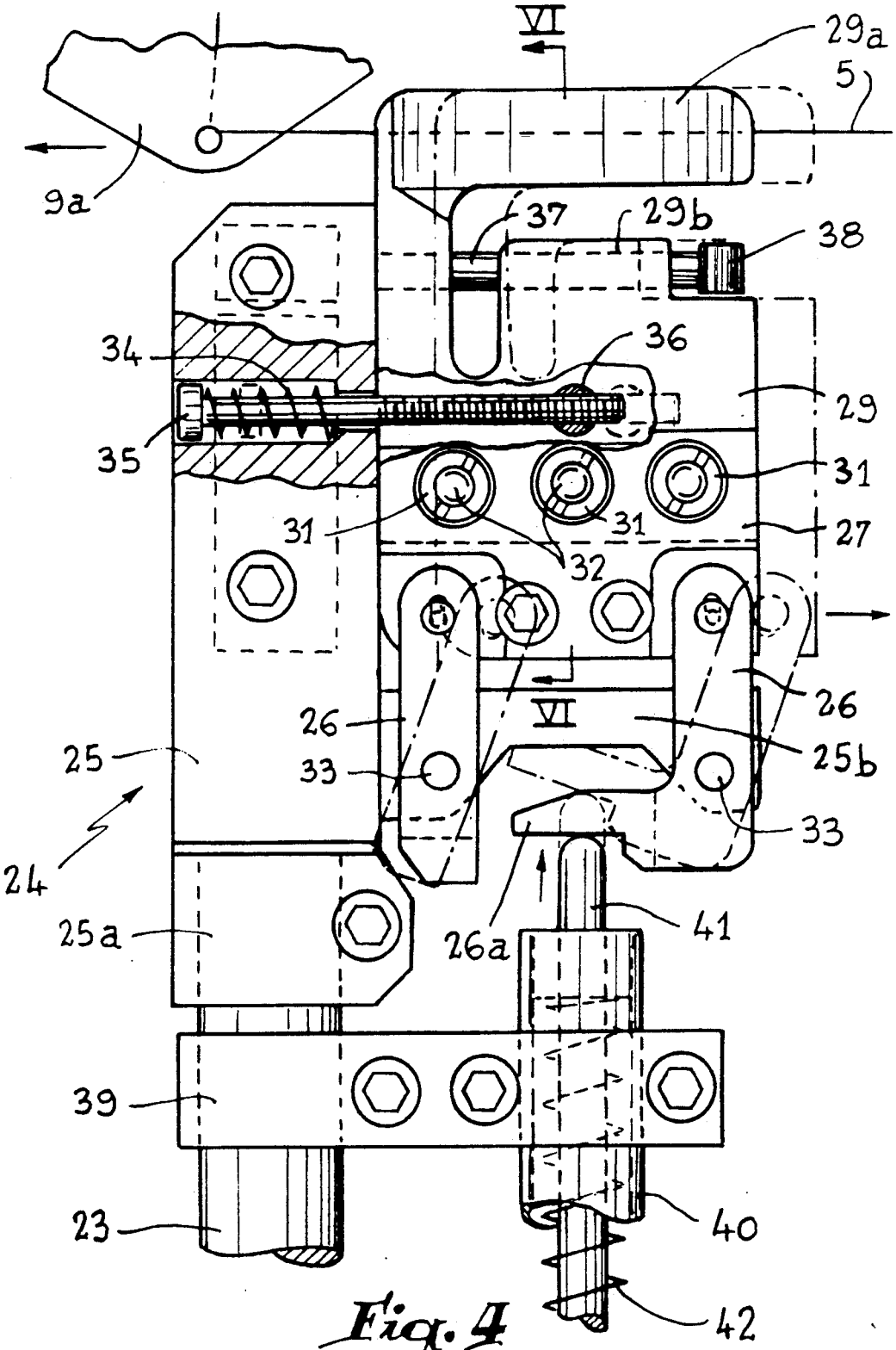
FIG. 4 shows in plan view, on a larger scale, one of the three clamps of the selector device.
Figure 5:
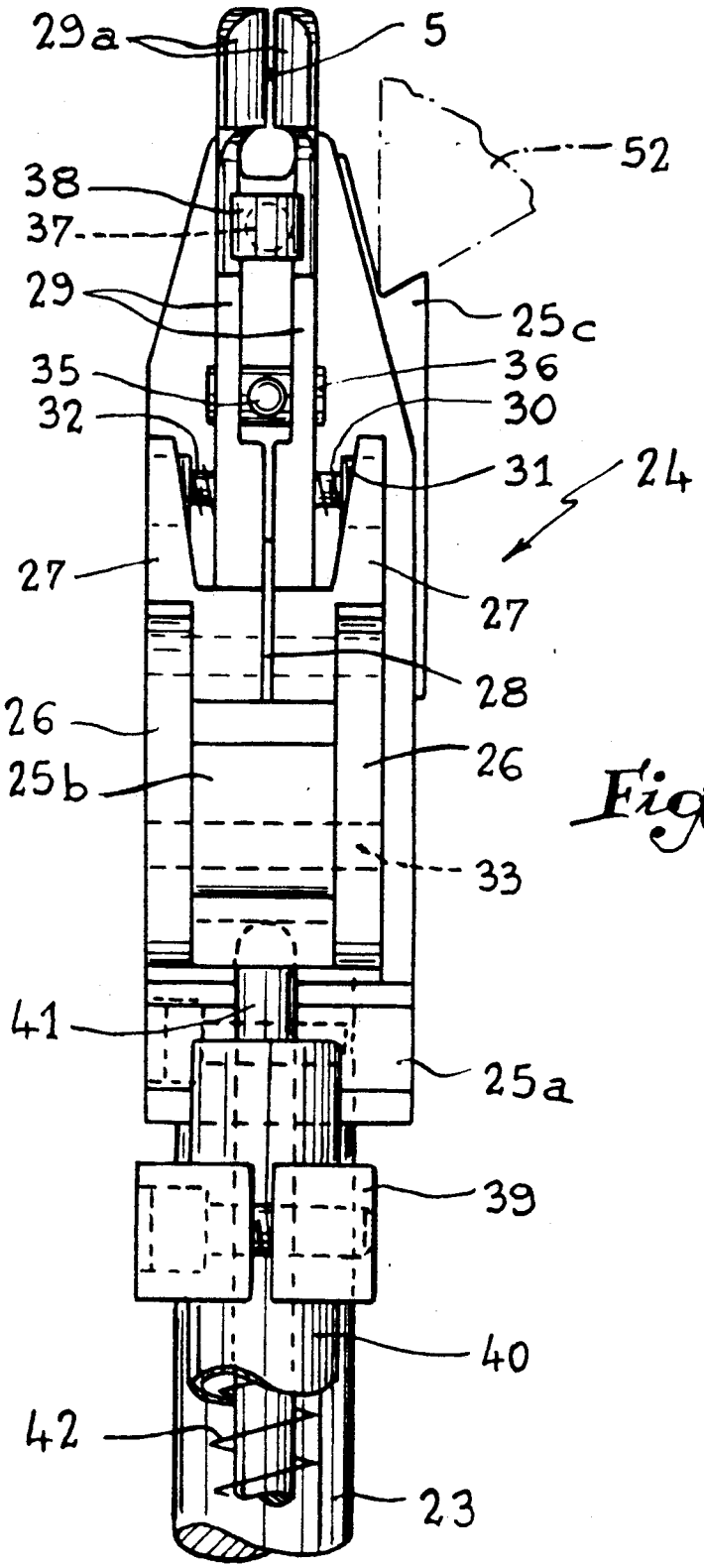
FIG. 5 is a side view of the clamp according to FIG. 4.
Figure 6:
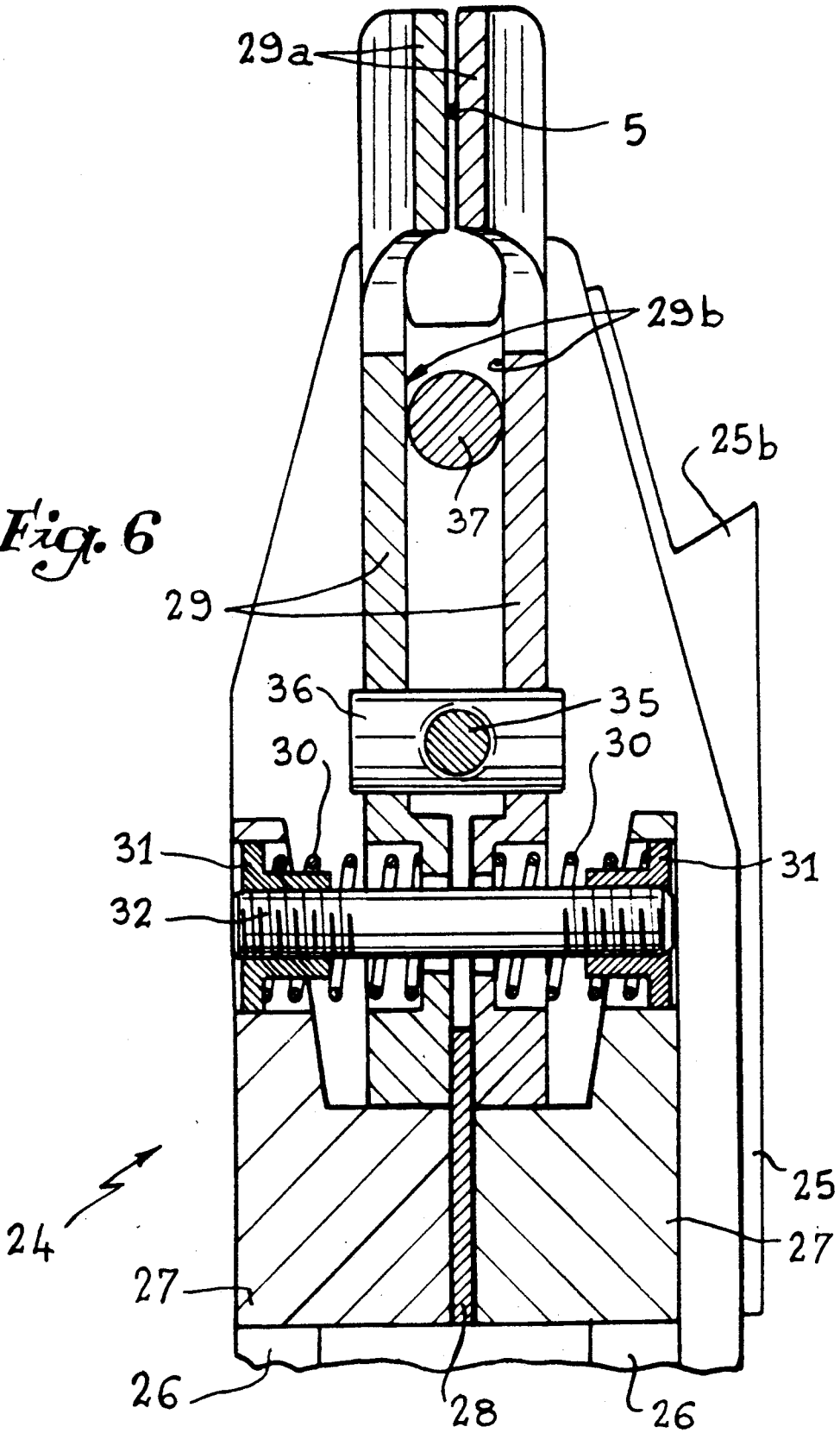
FIG. 6 is a detailed section of the end of the clamp along the plane of section VI—VI (FIG. 4).

The arrangement of each of the three clamps 24 of each device 8 is clearly visible in FIGS. 4, 5 and 6.

Each clamp comprises a principal body 25 provided with a split flange 25*a* which the end of the mobile member 23. This body 25 is secured to a lateral crosspiece 25*b* on which are freely articulated two double connecting rods 26, the free ends thereof encompassing two supports 27. As shown more particularly in FIG. 6, these two supports 27 maintain therebetween a blade 28 against which two jaw elements 29 are elastically or resiliently applied under the effect of return systems, three in number in the example in question. Each system comprises two opposite springs 30 compressed between one of the jaw elements 29 and a stop 31; the two stops 31 are screwed on the threaded ends of the same pin 32 which traverses with clearance the jaw elements 29 and whose guiding is ensured by the stops 31, engaged virtually without clearance in openings made in the supports 27.

As shown in FIG. 4, one of the double rods 26 is provided with an actuation heel 26*a* and it will be readily understood that if a pressure directed towards the interior of the clamp is exerted on the heel, the two rods 26 pivot about their pivots 33, which results in laterally displacing the assembly formed by the supports 27, the blade 28 and the jaw elements 29, in the manner illustrated in broken lines. Such lateral displacement is effected against elastic return elements constituted by a spring 34 housed in a cavity of the principal body 25 and maintained between the annular bottom of the cavity and the head of a screw 35 which is screwed in a cylindrical block 36, which is retained in holes made in one and the other jaw element 29.

It should be observed that the free end of each jaw element 29 is shaped in order to constitute a jaw 29*a* whose section is clearly visible in FIGS. 4 and 6. These jaws 29*a*, normally maintained applied against one another by springs 30, open automatically when the assembly formed by the supports 27, the central blade 28 and the jaw elements 29 moves laterally under the effect of a pressure exerted on the heel 26*a*. To that end, the body 25 is secured with a rod 37 which is oriented parallel to the screw 35 to engage between the jaw elements 29 and which includes at its end, a stop 38 sectioned to cooperate with bearing surfaces 29*b* provided on the jaw elements.

It will be readily appreciated that, at the end of the lateral displacement mentioned above, the bearing surfaces 29*b* are applied against the stop 38 which effects spacing thereof against the springs 30, thereby opening of jaws 29*a*.

The extendable member 23 of each clamp-holder jack 22–23 is assembled by a transverse flange 39 (FIG. 4) on a tubular rod 40 oriented parallel to the member. Inside this rod 40 there axially slides a pusher 41 associated with a return spring 42 adapted to actuate the heel 26*a* mentioned above.

Figure 7:
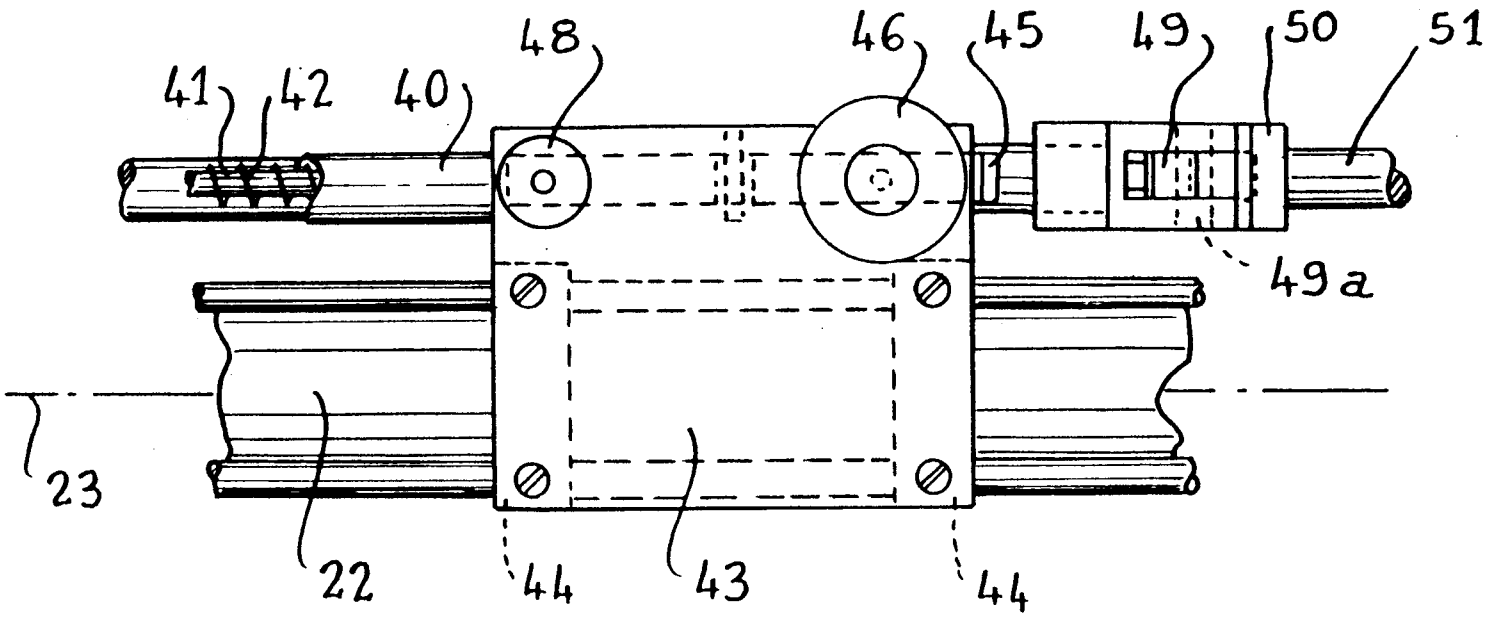
FIG. 7 is a partial plan view showing the arrangement of the mechanism for controlling one of the clamp-holder members.

In the manner shown in FIG. 2, the rod 40 associated with each jack 22–23 freely traverses the crosspiece 19 to cooperate with a stroke-limiting mechanism. This mechanism comprises a small plate 43 (FIGS. 7 to 9) with flanges 44 secured with the cylinder 22 of the jack and which is equipped with a pivoting blade 45 oriented parallel to the axis of the jack. The end of blade 45 which is turned towards pin 11 is subjected to the action of an electro-magnetic jack 46 which, when energized, pivots the end downwardly against elastic return element 47 associated with the opposite end of the blade and housed inside a small cover 48 secured to the plate 43.

Figure 8:
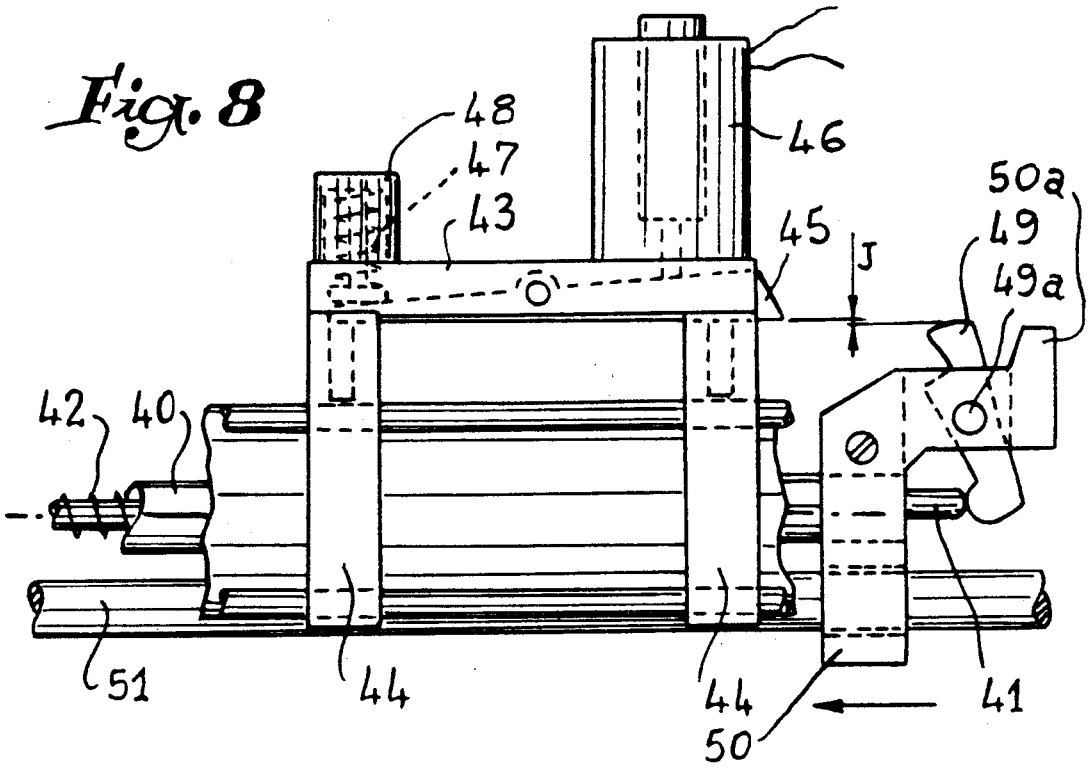
FIGS. 8 and 9 are side views illustrating the functioning of the mechanism of FIG. 7.
Figure 9:
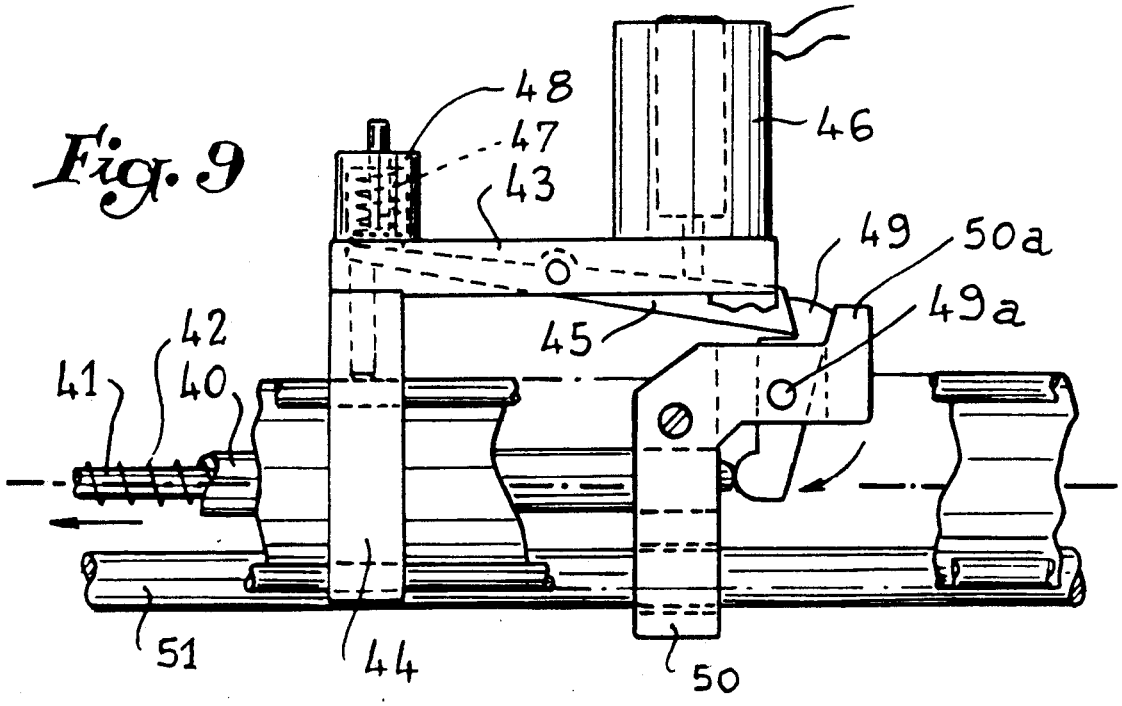

The pivoting blade 45 is intended to cooperate with a cock 49 articulated at 49*a* on a vertical lug 50 which is fixed on the free end of the tubular rod 40 and which slides freely over a guide bar 51, disposed below said rod, as illustrated in FIGS. 8 and 9. When the blade 45 is not actuated by the jack 46, the upper end of the cock 49 is arranged to have a very slight clearance indicated at J in FIG. 8 to pass freely below plate 43. On the contrary, when blade 45 is lowered by the above-mentioned jack, cock 49 strikes the end of the blade (cf. FIG. 9) and consequently pivots about its pivot 49*a*, then actuating the pusher 41 whose end passes beyond the end of the tubular rod 40.

The pusher 41 is thus displaced axially against its return spring 42, which has for its effect to actuate the clamp 24. It should be observed that the pivoting of the cock 49 is limited by bearing against a stop 50*a* of the lug 50, so that the longitudinal displacement of the extendable member 23 of the jack 22–23 cannot continue. It will be readily appreciated that this system for limiting stroke is capable of giving each extendable member 23 and the corresponding clamp 24 three different axial positions, namely:

1. a position of maximum extension for which the clamp 24 (case of the left-most one in FIG. 2 and the lowermost in FIG. 3) is presented at the level of the batten 2 assumed to be in rear position;

2. a position of maximum retraction (case of the other two clamps of FIGS. 2 and 3) for which each clamp 24 is disposed against the crosspiece 19 of the casing 10;

3. and a mean position (case shown in broken lines for the central clamp) for which each clamp 24 is located half-way between the two extreme positions.

It should be noted that the principal body 25 of each clamp 24 is provided with a shoulder or stop 25*c* (cf. FIGS. 3, 5 and 6) provided on the lower face of the body in order to cooperate with a corresponding bearing surface 52 which is laterally secured against the front face of the batten 2, at the level of each device 8 according to the invention. The cooperation of this shoulder or stop 25*c* and one or the other of the bearing surfaces 52 of the batten 2 ensures precise positioning of each of the clamps 24 with respect to the shuttles 9 when these clamps are in the position of maximum extension.

Before describing the operation of each of the two devices 8, it will be observed that the valves which ensure supply of the different pneumatic jacks 12–13, 14–15 and 22–23 as well as the contractors which control the electromagnetic jacks 46, are placed under the dependence of control assembly 53 which manages the different movements of the assembly formed by the two devices 8 and the loom.

It will be readily understood that this control assembly 53 is capable of being programmed so that, when the shuttle 9 which has just traversed the shed to lay a pick between the warp yarns 4, emerges from the yarn, one of the pneumatic jacks 22–23 is actuated to bring its clamp 24 to the position of maximum extension, at the same time as the jacks 12–13 and 14–15 are themselves supplied to displace the crosspiece 19 vertically and cause the stop 25*c* of clamp 24, at the end of stroke of the corresponding mobile member 23, to come into suitable position against the bearing surface 52 of the batten 2 which is then in retracted position.

At that moment, the jaws 29*a* of the jaw elements 29 of clamp 24 are applied against one another. Each shuttle 9 of the loom being provided with a lateral lug 9*a* (FIGS. 2 and 4) with an opening traversed by the corresponding warp yarn 5, it will be readily understood that lug 9*a* will penetrate between the jaws 29*a* that it opens by force against the springs 30. The springs 30 return the jaw elements 29 to the closed position as soon as lug 9*a* has emerged from clamp 24 and jaws 29*a* close on the yarn 5 which is firmly clamped. The pick which has just been placed is thus maintained under tension.

While the shuttle in question finishes its stroke as far as the interior of box 1, the control assembly 53 returns the clamp 24 to the position of maximum retraction, with the result that the batten 2 may effect its conventional movement of tightening without being hindered by the clamp 24. When this same shuttle 9 is projected out of the box 1 to deposit a fresh pick, the control assembly 53 actuates the jack 22–23 and the corresponding jack 46 so that the clamp 24 takes the mean position. When the pusher 41 is displaced axially by the cock 49, the jaw elements 29 open and the jaws 29*a* release the weft yarn 5 which was previously relaxed in response to the lateral movement of the jaw elements. The shuttle 9 is thus capable of depositing the pick in the shed, without any risk of defect.

As soon as yarn 5 has thus been released, the control assembly 53 returns the clamp 24 against the crosspiece 19 and the device 8 is then ready to operate again. It is the opposite device 8 which will seize the weft yarn 5 to maintain it under tension.

Finally, it will be readily appreciated that, if the devices 8 are provided with a number of clamps 24 and of clamp-holders 23—23 equal to that of the shuttles 9 of the loom, all the weft yarns 5 are maintained under tension. As the clamps 24 of the same device 8 are located at different heights, any risk of entangling and of defect is systematically avoided however the shuttles bounce when they come to the and of stroke in the boxes 1 and whatever the distance separating the selvedges of the fabric being made and the boxes 1.

It will be readily understood that the invention may be advantageously employed even when the loom comprises only one shuttle.

What is claimed is:

1. A device adapted to be mounted on each side of a weaving loom in generally opposing relationship to a loom batten wherein the loom includes shuttles which are movable between shuttle boxes on each side of the loom batten and wherein controls are provided for operation of the loom batten and shuttle boxes, the device being positioned generally between the selvedge of fabric being made in the loom and adjacent shuttle box and which device further maintains weft yarns under tension leaving a loop shed defined by weft yarns wherein the device comprises in combination:

a) a series of extendable members in a number equal to the number of shuttles of the loom, said extendable members extending parallel to the warp yarns and being vertically spaced with respect to one another;

b) a clamp provided at the end of each of said extendable members and including means to grip weft yarn which has been deposited by one of said shuttles and which releases the yarn when said one of said shuttles emerges from an adjacent shuttle box;

c) adjustable support means for raising and lowering said extendable members in a vertical plane;

d) means associated with said extendable members for selectively moving each of said clamps to a first extended position in which said clamps are disposed adjacent to the batten so as to enable the clamps to seize weft yarn which has just been deposited, a retracted position in which said clamps are positioned outside the reciprocating movement of the batten, and a mean position for which said clamps lie at a short distance from the batten to enable weft yarns to be released as the shuttles enter into the shed; and e) an automatic control means for actuating said adjustable support means and said means associated with each of said extendable members in synchronism with the controls for the batten and the shuttle boxes.

2. The device of claim 1 wherein each extendable member includes a first pneumatic jack having a cylinder which is pivotally mounted on a fixed box and from which a piston rod is reciprocally extendable, a crosspiece for supporting said first pneumatic jack, and means for connecting said crosspiece to said adjustable support means.

3. The device of claim 2 wherein said adjustable support means includes a second pneumatic jack including a reciprocally extendable piston rod connected to said crosspiece.

4. The device of claim 11 wherein each of said clamps includes a stop means, the loom batten including a bearing surface, said stop means being engagable with said bearing surface when said extendable members are moved so as to position said clamps to said extended position.

5. The device of claim 1 wherein each shuttle includes a lug extending laterally thereof, said clamps including two jaw elements for selectively griping the weft yarn, means for resiliently urging said jaws towards one another, and means for retaining said jaws in spaced relationship so that said lug of said shuttle may be passed between said jaw elements.

6. The device of claim 5 including means for moving said clamps transversely the warp yarns to thereby relax the weft yarn when said extendable members position said clamps in said mean position.

7. The device of claim 6 wherein each clamp includes a principle body portion, said jaw elements being coupled to said principle body portion by connecting rods, at least one of said connecting rods including an actuation heel means, and means for selectively engaging said heel means to thereby open said jaw elements relative to one another against said resilient means.

8. The device of claim 7 wherein said principle body portion of each clamp includes a fixed stop, each of said jaw elements including a bearing surface, said bearing surfaces being engagable with said fixed stops so as to selectively move said jaw elements outwardly with respect to one another.

9. The device of claim 7 in which each of said extendable members include a hollow rod member extending generally parallel to said piston rods thereof, mechanisms for limiting the extension of each of said extendable members, each mechanism including a blade element and means to selectively move said blade element between fist and second positions, a lug means mounted to each of said hollow rod members, said blade elements being engagable with said lug means when said blade elements are in said second position to thereby retain said clamps of said extendable members in said means position with said jaw elements in an open position relative to one another.

10. The device of claim 9 in which said means for engaging said actuation heel means of said one of said connecting rods includes a pusher element slidably positioned within said hollow rod member, a pivotal cock mounted between said blade element and said lug means so as to be selectively engagable by said blade element to thereby urge said pusher element to engage said actuation heel means, and resilient means for urging said pusher element away from said actuation heel means.

* * * * *